US005570843A

United States Patent [19]

Heyse et al.

[11] Patent Number: 5,570,843

[45] Date of Patent: Nov. 5, 1996

[54] FUEL INJECTION VALVE WITH SEMICIRCULAR FLATTENINGS

[75] Inventors: Joerg Heyse, Markgroeningen; Michael Klaski, Erdmannhausen, both of Germany

[73] Assignee: Robert Bosch GmbH, Stuttgart, Germany

[21] Appl. No.: 376,724

[22] Filed: Jan. 23, 1995

[30] Foreign Application Priority Data

Mar. 16, 1994 [DE] Germany ..... 44 08 875.2

[51] Int. Cl.[6] ..... B05B 1/30

[52] U.S. Cl. ..... 239/585.1; 239/585.4; 239/900; 251/120; 251/126

[58] Field of Search ..... 239/585.1, 585.4, 239/585.5, 900, 533.12; 251/120, 126, 129.14

[56] References Cited

U.S. PATENT DOCUMENTS

| | | | |
|---|---|---|---|
| 4,423,843 | 1/1984 | Palma | 239/900 X |
| 4,494,701 | 1/1985 | Hensley et al. | 239/585 |
| 4,520,962 | 6/1985 | Momono et al. | 239/585 |
| 4,711,397 | 12/1987 | Lahiff | 239/900 X |
| 5,199,648 | 4/1993 | Fujikawa | 239/585.4 |

FOREIGN PATENT DOCUMENTS

| | | |
|---|---|---|
| 33 35 169 A1 | 4/1984 | Germany . |
| 42 30 376 C1 | 4/1993 | Germany . |

*Primary Examiner*—Lee W. Young
*Attorney, Agent, or Firm*—Kenyon & Kenyon

[57] ABSTRACT

A fuel injection valve includes a valve-closure member which is provided with semicircular flattenings. The deflecting surfaces delimiting the flattenings and formed obliquely to the longitudinal valve axis cause a rotational energy to be applied to the fuel. The application of rotational energy to the fuel makes it possible to clearly reduce the change in flow rate caused by the rotational position of the needle, so that the variance in the static flow rate is considerably decreased. The valve is particularly suitable for application in fuel injection systems of mixture-compressing internal combustion engines having externally supplied ignition.

12 Claims, 3 Drawing Sheets

FUEL INJECTION VALVE WITH SEMICIRCULAR FLATTENINGS

FIELD OF THE INVENTION

The present invention relates to a fuel injection valve.

BACKGROUND INFORMATION

German Patent Application No. 33 35 169 describes a fuel injection valve, in which a spherical valve element having a plurality of flattenings (truncated sections) on its periphery is installed as a valve-closure member to allow fuel to flow around the sphere and thus arrive at the valve seat. The flattenings on the spherical valve-closure member are needed when the valve-seat body has a complete ring guide for positioning and aligning the valve-closure member, since otherwise the fuel would dam up at the sphere and not flow through to the valve seat. The flattenings introduced on the periphery of the valve-closure member are formed in a circular shape and are not spatially associated with the spray-outlet orifices provided on the downstream end of the injection valve.

A fuel injection valve having a valve-closure member of a similar design is described in German Patent No. 42 30 376. Here as well, the circular flattenings on the surface area of the spherical valve-closure member have the function of allowing fuel to flow out of an inside valve space, into which the valve needle extends, to spray-outlet orifices of the injection valve. In this case, there is no fixed association between the flattenings on the valve-closure member and the-spray-outlet orifices. On the contrary, the torsional position of the valve needle, and thus of the valve-closure member, is arbitrary, and therefore, also varies among the individual injection valves of a production series. The flow of oncoming fuel to the individual (e.g., four) spray-outlet orifices is also determined by the flattenings.

A spray-outlet orifice is supplied more efficiently with the medium to be sprayed off when a flattening is situated directly upstream. However, if a guide edge, formed between two flattenings, is located above the spray-outlet orifice, then the result can be that the spray-outlet orifice is insufficiently supplied. The irregularity (unevenness) of the oncoming flow in the circumferential direction thus brings about a change in the flow rate and an increased variance in the static flow rate relative to the rotational position of the valve needle.

A fuel injection valve having a spherical valve-closure member (globe valve) is described by U.S. Pat. No. 4,520,962. This valve-closure member has no means on its periphery for fuel to flow past. On the contrary, the fuel flows immediately upstream from the valve seat, coming from the side, directly to the valve-closure member. An additional spiral member having spiral-shaped grooves is provided downstream from the valve seat, in which case the grooves apply a rotational energy to the fuel. The fuel is then sprayed off through a single outlet orifice.

Additionally, U.S. Pat. No. 5,199,648 describes a fuel injection valve, in which a valve-closure member that is securely joined to the valve needle, has a plurality of grooves running at an angle to the longitudinal valve axis. The depth of the grooves can be constant over the entire length or be diminished toward the ends of the grooves while the deepest spots are in the middle of the grooves. The grooves differ from the flattenings in that they no longer run only directly on the surface of the valve-closure member, but have groove bottoms that lie more deeply in the material. In addition to the opening and closing on the valve seat, the spherical valve-closure member also fulfills the function of valve-needle guidance. The grooves serve to allow the medium to flow through from the inside valve space to the valve seat, a rotational energy being applied to the fuel by the angled grooves, and a better atomization supposedly being achieved. The fuel then emerges downstream from the valve seat through a centrally arranged spray-outlet orifice; thus, it is not distributed among a plurality of spray-outlet orifices. The disadvantage of this groove formation is that the total fuel flowing from the inside valve space to the valve seat is heavily deflected therein and suffers a loss of pressure, since the grooves effect a substantial resistance to flow.

SUMMARY OF THE INVENTION

An advantage of the fuel injection valve according to the present invention is that in the case of an injection via a plurality of spray-outlet orifices, for example of an apertured spray disk, the fuel is guided past the valve-closure member in a simple manner so as to allow a nearly equal distribution to the individual spray-outlet orifices. The flattenings on the periphery of the valve-closure member, produced according to the present invention by a simple and cost-effective method, guarantee that a nearly unthrottled generation of rotational (swirling) energy in the fuel, through which means the irregularity of the oncoming flow is evened out in the circumferential direction by the rotational position of the valve needle, so that the static fuel-flow rate is able to be reproduced considerably better, even given very large quantities of fuel injection valves, and remains very stable. The variance in the static flow rate can be restricted to a minimum.

DETAILED DESCRIPTION OF THE INVENTION

Figure 1:
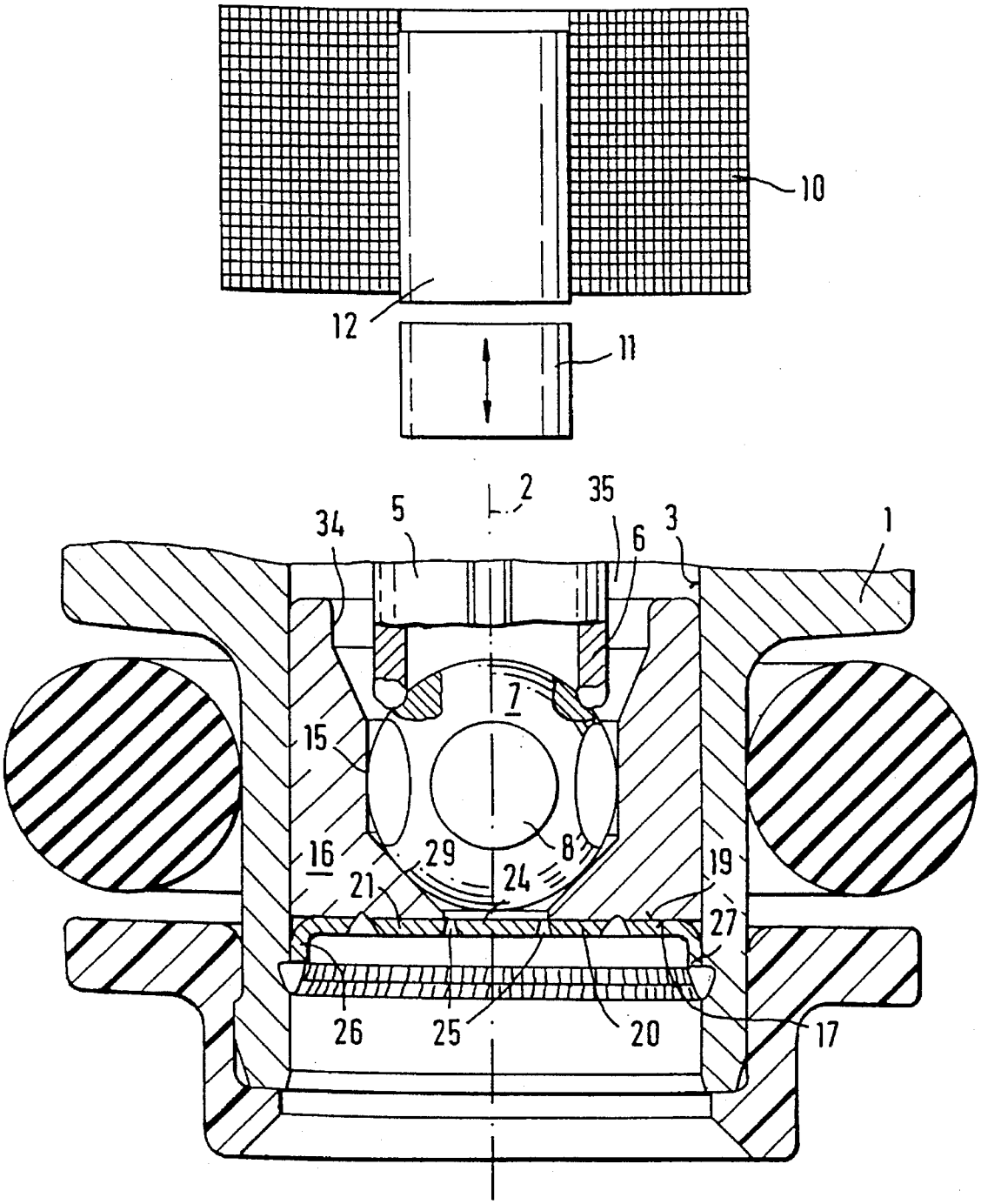
FIG. 1 depicts a partial view of an injection valve having circular flattenings on the valve-closure member.

In a partial view, FIG. 1 illustrates an example of a valve in the form of an injection valve for fuel injection systems of mixture-compressing internal combustion engines having externally supplied ignition. The injection valve has a tubular valve-seat support 1, in which a longitudinal orifice 3 is formed concentrically to a longitudinal valve axis 2. Arranged in the longitudinal orifice 3 is, for example, a tubular valve needle 5, which is joined at its downstream end 6 to a spherical valve-closure member 7, on whose periphery, for example, five circular flattenings 8 are provided.

The injection valve is actuated electromagnetically, for example, in a generally known way. A sketched electromagnetic circuit having a solenoid coil 10, an armature 11, and a core 12 serves to axially move the valve needle 5 and, thus, to open the injection valve against the spring energy of a restoring spring (not shown) or to close the same. The armature 11 is joined to the end of the valve needle 5 facing away from the valve-closure member 7, for example, by a laser-produced weld and is aligned to the core 12.

A guide opening 15 of a valve-seat member 16 is used to guide the valve-closure member 7 during axial movement. The cylindrical valve-seat member 16 is tightly mounted by means of welding in the end of the valve-seat support 1 situated downstream and facing away from the core 12 in the longitudinal orifice 3 running concentrically to the longitudinal valve axis 2. The circumference of the valve-seat member 16 has a slightly smaller diameter than the longitudinal orifice 3 of the valve-seat support 1. At its lower front end 17 facing away from the valve-closure member 7, the valve-seat member 16 is concentrically and rigidly joined to a base part 20 of a, for example, pot-shaped apertured spray disk 21, so that the base part 20 abuts with its upper front end 19 on the lower front end 17 of the valve-seat member 16. In its central area 24, the base part 20 of the apertured spray disk 21 has at least one, for example four, spray-outlet orifices 25 formed by means of erosion or punching.

Contiguous to the base part 20 of the pot-shaped apertured spray disk 21 is a circumferential retention rim 26, which extends in the axial direction facing away from the valve-seat member 16 and is bent conically to the outside up to its end 27. Since the circumferential diameter of the valve-seat member 16 is smaller than the diameter of the longitudinal orifice 3 of the valve-seat support 1, a radial compression exists only between the longitudinal orifice 3 and retention rim 26 of the apertured spray disk 21, which retention rim 26 is bent slightly conically to the outside.

The insertion depth of the valve-seat part comprised of the valve-seat member 16 and the pot-shaped apertured spray disk 21 into the longitudinal orifice 3 determines the presetting of the lift of the valve needle 5, since the one end position of the valve needle 5, given a non-excited solenoid coil 10, is determined by the seating of the valve-closure member 7 on a valve-seat surface 29 of the valve-seat member 16. The other end position of the valve needle, given an excited solenoid coil 10 is determined, for example, by the fitting of the armature 11 on the core 12. Thus, the path between these two end positions of the valve needle 5 represents the lift.

At its end 27, the retention rim 26 of the apertured spray disk 21 is imperviously and securely joined to the inner wall of the longitudinal orifice 3. An impervious connection of the valve-seat member 16 and the apertured spray disk 21, as well as of the apertured spray disk 21 and the valve-seat support 1 is necessary to ensure that the fuel cannot flow through between the longitudinal orifice 3 of the valve-seat member 1 and the periphery of the valve-seat member 16 to the spray-outlet orifices 25, or through between the longitudinal orifice 3 of the valve-seat support 1 and the retention rim 26 of the pot-shaped apertured spray disk 21 directly into a suction line of the internal combustion engine.

The spherical valve-closure member 7 interacts with the valve-seat surface 29 of the valve-seat member 16, this valve-seat surface being tapered in a truncated-cone shape in the direction of flow and being formed in the axial direction between the guide opening 15 and the bottom front end 17 of the valve seat-member 16. Facing the solenoid coil 10, the valve-seat member 16 has a valve-seat member opening 34, which has a larger diameter than the diameter of the guide opening 15 of the valve-seat member 16. The valve-seat member opening 34 serves as a flow inlet, so that a flow of the medium, such as fuel, can take place from an inside valve space 35 delimited in the radial direction by the longitudinal orifice 3 of the valve-seat support 1 to the guide opening 15 of the valve-seat member 16.

To ensure that the flow of the medium also attains the spray-outlet orifices 25 of the apertured spray disk 21, five flattenings 8 are introduced, for example, on the periphery of the spherical valve-closure member 7. The five circular flattenings 8 enable the medium to flow through in the open state of the injection valve from the inside valve space 35 to the spray-outlet orifices 25 of the apertured spray disk 21. To provide for an exact guidance of the valve-closure member 7 and, thus, of the valve needle 5 during the axial movement, the diameter of the guide opening 15 is conceived so as to allow the spherical valve-closure member 7, outside of its flattenings 8, to project through the guide opening 15 with little radial clearance. There is no fixed association between the flattenings 8 on the valve-closure member 7 and the spray-outlet orifices 25.

Figure 2:
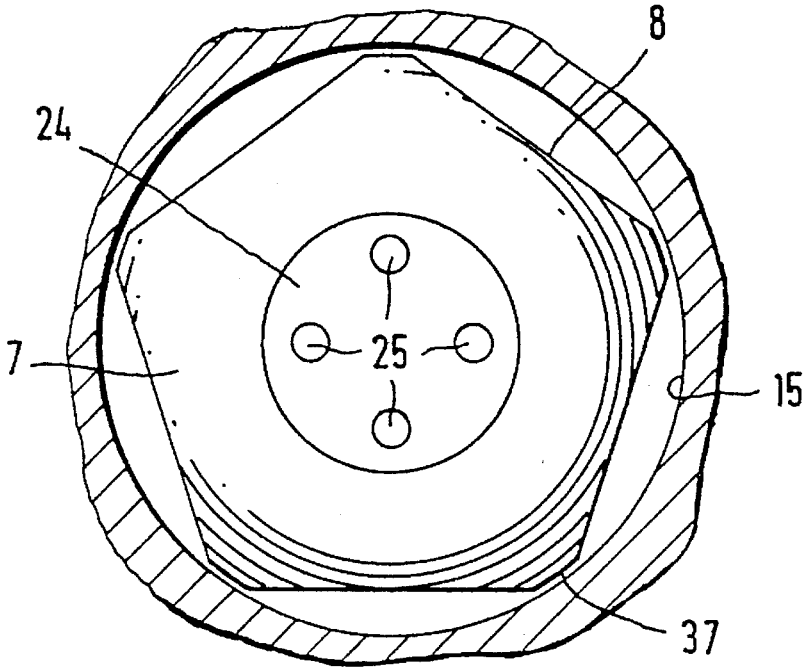
FIG. 2 shows a valve-closure member according to FIG. 1 with spray-outlet orifices projected thereon.

FIG. 2 illustrates this situation once again through the use of a block diagram (which is not entirely to scale and does not show a direct intersection through the injection valve). Rather, to clarify the geometry, the spray-outlet orifices 25 of the apertured spray disk 21 are projected on to the spherical valve-closure member 7.

Since the torsional position of the valve needle 5 relative to the valve-closure member 7 is arbitrary in each injection valve, different positions of the flattenings 8 arise again and again with respect to the spray-outlet orifices 25. The oncoming flow of the fuel to the individual, for example four, spray-outlet orifices 25, is determined, as well, by the flattenings 8. A spray-outlet orifice 25 is more efficiently supplied with fuel when a flattening 8 is situated directly upstream. However, if a guide edge 37 formed between two flattenings 8 is located above the spray-outlet orifice 25, then this can result in the spray-outlet orifice being insufficiently supplied. The resultant unequal distribution of fuel upstream from the apertured spray disk 21 inevitably manifests certain instabilities, so that the consequence is an increased variance in the static flow rate through the individual spray-outlet orifices 25 and between the individual injection valves.

Figure 3:
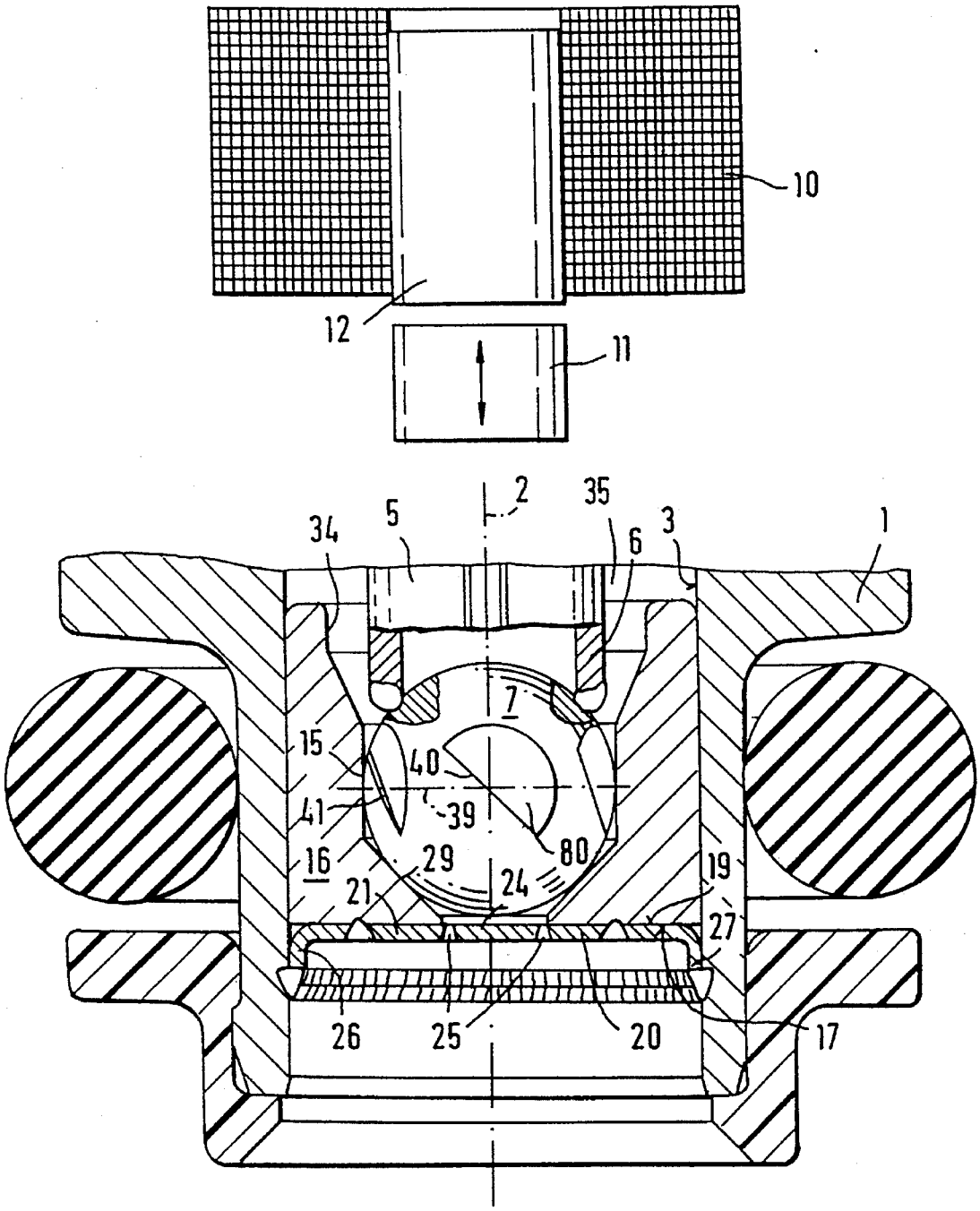
FIG. 3 illustrates a partial view of an injection valve having semicircular flattenings on the valve-closure member according to the present invention.

One exemplary embodiment of an injection valve according to the present invention is shown in a partial representation in FIG. 3, the same parts or the parts having the same function with respect to the injection valve shown in FIG. 1 being designated with the same reference numerals. As a special feature, the valve-closure member 7 now only has flattenings 80, which differ in their shape and geometric dimensions from those already known. The flattenings 80 that are attainable, for example, by means of milling or grinding on the surface of the spherical valve-closure member 7 are designed in a semicircular shape. In this case, a deflection surface 41 runs along a bisecting line 40, which corresponds to the line of intersection when a complete circle is cut into two semicircles and, thus, also corresponds to the complete circle's diameter, is not curved, and is not parallel to the longitudinal valve axis 2. Rather, the deflection surface 41 along the bisecting line 40 obliquely intersects a globe equator 39 running perpendicularly to the longitudinal valve axis 2, for example, at an angle of 45°, as shown in FIG. 3. The angle between the deflection surfaces 41 delimiting the flattenings 80, which can be described as ground-down edges for applying a rotational energy (ground-down swirl edges), and the ball equator 39 can also deviate from 45°. The deflection surfaces 41 run at an angle to the flattenings 80 and extend toward the ball midpoint.

Thus, the purpose of the flattenings 80 running at an angle to the longitudinal valve axis 2 is to guarantee that the spray-outlet orifices 25 are supplied with fuel and to apply a rotational energy to the fuel. The application of rotational energy to the inner fuel flow of the injection valve makes it possible to clearly reduce the change in flow rate caused by the rotational position of the needle at the spray-outlet openings 25 and between the individual injection valves, so that in certain types of injection valves, the variance in the static flow rate amounts to just 50% of the variance in the comparable injection valves having circular flattenings 8.

It is especially advantageous to form semicircular flattenings 80 on the valve-closure members 7 when injection valves having so-called small-quantity apertured spray disks are used. Such small-quantity apertured spray disks have, for example, only two spray-outlet orifices 25, so that under the state of the art, the torsional position of the valve needle 5 has a considerable effect on the variance in the static flow rate. Injection valves, which comprise small-quantity apertured spray disks having a spray-off fuel volume of 60 to 80 g/min, are of particular interest in the case of high-speed, two-stroke internal combustion engines. It is especially the case for internal combustion engines having a small displacement cubic capacity, for example of between 500 and 1000 $cm^3$, that decisive reductions in the variance of the static flow rate and, thus, considerable improvements in the stability of the fuel quantities to be spray-ejected (sprayed off) are able to be achieved due to the flattenings 80 on the valve-closure member 7 and the resultant swirled inner flow. In the case of apertured spray disks 21 having spray-off fuel volumes of 150 g/min and more, the described positive effects become especially noticeable when only one or two spray-outlet orifices 25 are provided.

The refinement according to the present invention of the semicircular flattenings 80 enables fuel to flow past the valve-closure member 7 over a large surface area without any significant pressure losses resulting from a resistance to flow.

Figure 4:
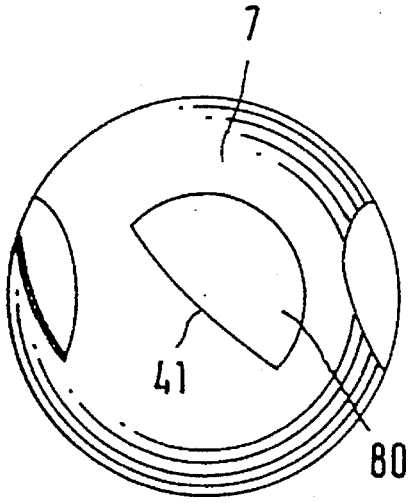
FIG. 4 shows a second exemplary embodiment of a valve-closure member according to the present invention.
Figure 5:
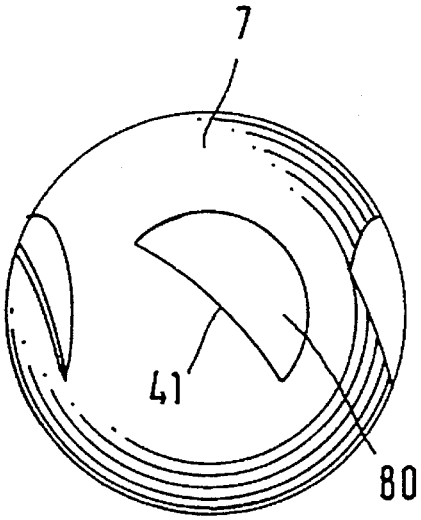
FIG. 5 shows a third exemplary embodiment of a valve-closure member according to the present invention.

FIGS. 4 and 5 depict two additional exemplary embodiments of valve-closure members 7 according to the present invention. The spherical valve-closure members 7 now have two flattenings 80, which deviate slightly from a semicircular shape. The deflection surfaces 41 do not run, exactly (straight) along the bisecting lines 40 through a complete circle, but rather in a slightly curved convex or concave shape. FIG. 4 depicts a valve-closure member 7, which has a convex deflecting surface 41 that produces a stronger deflection of the fuel. On the other hand, the valve-closure member 7 in FIG. 5 has concave deflection surfaces 41 on the flattenings 80, so that the fuel is deflected to a lesser extent. Thus, specific swirl directions are able to be produced with these specific embodiments.

What is claimed is:

1. A fuel injection valve for supplying an internal combustion engine with fuel, the valve having a longitudinal valve axis, comprising:

a spherical valve-closure member having a periphery;

a valve-seat surface with which the spherical valve-closure member interacts, allowing fuel to flow along the longitudinal valve axis, along the valve-closure member;

at least one spray-outlet orifice downstream from the valve-seat surface; and a plurality of substantially semicircular flattenings on the periphery of the valve-closure member, the flattenings being delimited by at least one deflecting surface which runs at an angle to the flattenings and runs obliquely to the longitudinal valve axis.

2. The fuel injection valve according to claim 1, wherein the deflecting surface intersects a globe equator at approximately 45 degrees, the globe equator running perpendicular to the longitudinal valve axis.

3. The fuel injection valve according to claim 1, wherein the flattenings are produced by at least one of milling and grinding.

4. The fuel injection valve according to claim 1, wherein the deflecting surface runs concavely toward the flattenings.

5. The fuel injection valve according to claim 1, wherein the deflecting surface runs convexly toward the flattenings.

6. The fuel injection valve according to claim 1, wherein the flattenings are delimited by a plurality of deflecting surfaces.

7. A fuel injection valve for supplying an internal combustion engine with fuel, the valve having a longitudinal valve axis, comprising:

a spherical valve-closure member having a periphery;

a valve-seat surface with which the spherical valve-closure member interacts, allowing fuel to flow along the valve-closure member in an extension direction of the longitudinal valve axis;

at least one spray-outlet orifice downstream from the valve-seat surface; and at least one substantially semicircular flattening at the periphery of the valve-closure member, the flattening being delimited by at least one deflecting surface positioned obliquely to the longitudinal valve axis.

8. The fuel injection valve according to claim 7, wherein the deflecting surface intersects a globe equator running perpendicular to the longitudinal valve axis at an angle approximately equal to 45 degrees.

9. The fuel injection valve according to claim 7, wherein the flattenings are produced by milling or grinding.

10. The fuel injection valve according to claim 7, wherein the deflecting surface runs concavely toward the flattenings.

11. The fuel injection valve according to claim 7, wherein the deflecting surface runs convexly toward the flattenings.

12. The fuel injection valve according to claim 7, wherein the flattening is delimited by a plurality of deflecting surfaces.

* * * * *